US007495640B2

(12) United States Patent
Willis

(10) Patent No.: US 7,495,640 B2
(45) Date of Patent: Feb. 24, 2009

(54) REDUCING SPARKLE ARTIFACTS WITH POST GAMMA CORRECTION SLEW RATE LIMITING

(75) Inventor: Donald Henry Willis, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 235 days.

(21) Appl. No.: 09/892,347

(22) Filed: Jun. 27, 2001

(65) Prior Publication Data

US 2002/0126075 A1 Sep. 12, 2002

Related U.S. Application Data

(60) Provisional application No. 60/275,186, filed on Mar. 12, 2001.

(51) Int. Cl.
*G09G 3/36* (2006.01)

(52) U.S. Cl. ..... 345/87; 345/89; 345/98

(58) Field of Classification Search ..... 345/87, 345/11, 22, 29, 213, 690, 98, 82, 156, 89, 345/589; 348/447, 790, 572, 597, 743, 238, 348/744, 254, 623; 382/261, 274; 250/226, 250/252.1; 341/145, 144
See application file for complete search history.

(56) References Cited

U.S. PATENT DOCUMENTS 4,507,679 A * 3/1985 Bendell ..... 348/238
4,523,230 A * 6/1985 Carlson et al. ..... 348/623
4,855,831 A * 8/1989 Miyamoto et al. ..... 348/597
5,247,169 A * 9/1993 Okada et al. ..... 250/226
5,361,094 A * 11/1994 Jang ..... 348/254
5,748,171 A 5/1998 Ishizaki et al.
5,936,621 A * 8/1999 Medin et al. ..... 345/213
6,108,053 A * 8/2000 Pettitt et al. ..... 348/743
6,208,327 B1 * 3/2001 Ho et al. ..... 345/690
6,219,101 B1 * 4/2001 Sani et al. ..... 348/447
6,229,508 B1 * 5/2001 Kane ..... 345/82

(Continued)

FOREIGN PATENT DOCUMENTS

EP 1225 558 7/2002

(Continued)

OTHER PUBLICATIONS

Zhang, Yanli, "Control of Disclinations and Walls in New Types of Display Devices", dissertation, Dec. 2005 URL: http://www.ohiolink.edu/etd/view.cgi?acc_num=kent1132453741 [Fig. 5 and Section 5.1 seem relevant.].

*Primary Examiner*—Prabodh M Dharia
(74) *Attorney, Agent, or Firm*—Robert D. Shedd; Harvey D. Fried

(57) ABSTRACT

An apparatus for reducing sparkle artifacts (10) in a liquid crystal imager includes a device (16) for gamma correcting a video drive signal for providing a gamma corrected video drive signal and a slew rate limiter (22) for slew rate limiting the gamma corrected video drive signal. The apparatus also includes a deinterlacer (12) and a color space converter (14) for color space converting a deinterlaced video drive signal, wherein the device for gamma correcting corrects the color space converted video drive signal. One or more of the video drive signals, for example R, G and B, is slew rate limited after gamma correction to limit the difference in brightness levels between adjacent pixels.

14 Claims, 1 Drawing Sheet

U.S. PATENT DOCUMENTS

| | | | | |
|---|---|---|---|---|
| 6,256,425 | B1 * | 7/2001 | Kunzman | 382/274 |
| 6,347,161 | B1 * | 2/2002 | Mancuso | 382/261 |
| 6,359,663 | B1 * | 3/2002 | Gadeyne et al. | 348/790 |
| 6,392,717 | B1 * | 5/2002 | Kunzman | 348/744 |
| 6,429,904 | B2 * | 8/2002 | Sani et al. | 348/572 |
| 6,445,323 | B1 * | 9/2002 | Cairns et al. | 341/144 |
| 6,556,162 | B2 * | 4/2003 | Brownlow et al. | 341/145 |
| 6,618,030 | B2 * | 9/2003 | Kane et al. | 345/82 |
| 6,724,437 | B2 | 4/2004 | Funke et al. | |
| 6,737,639 | B2 * | 5/2004 | Huniu | 250/252.1 |
| 6,831,634 | B1 * | 12/2004 | Shigeta | 345/213 |
| 6,961,039 | B2 | 11/2005 | Willis | |
| 7,071,909 | B2 | 7/2006 | Willis et al. | |
| 7,119,774 | B2 | 10/2006 | Willis et al. | |
| 2001/0024186 | A1 * | 9/2001 | Kane et al. | 345/98 |
| 2002/0030620 | A1 * | 3/2002 | Cairns et al. | 341/145 |
| 2002/0067337 | A1 * | 6/2002 | Klink | 345/156 |
| 2002/0097359 | A1 | 7/2002 | Chuang | |
| 2002/0126079 | A1 * | 9/2002 | Willis et al. | 345/89 |
| 2002/0126080 | A1 * | 9/2002 | Willis et al. | 345/89 |
| 2002/0126134 | A1 * | 9/2002 | Willis et al. | 345/589 |
| 2003/0156091 | A1 | 8/2003 | Willis | |

FOREIGN PATENT DOCUMENTS

| | | |
|---|---|---|
| JP | 2000-29428 | 1/2000 |
| JP | 2001-184016 | 7/2001 |
| JP | 2001-222264 | 8/2001 |
| JP | 2002-328653 | 11/2002 |
| JP | 2002-351382 | 12/2002 |
| WO | WO 01/73741 | 10/2001 |

* cited by examiner

REDUCING SPARKLE ARTIFACTS WITH POST GAMMA CORRECTION SLEW RATE LIMITING

CROSS REFERENCE TO RELATED APPLICATIONS

This is a non-provisional application of provisional application Ser. No. 60/275,186 filed Mar. 12, 2001.

BACKGROUND OF THE INVENTION

1. Field of the Invention

This invention relates to the field of video systems utilizing a liquid crystal display (LCD), and in particular, to video systems utilizing normally white liquid crystal on silicon imagers.

2. Description of Related Art

Liquid crystal on silicon (LCOS) can be thought of as one large liquid crystal formed on a silicon wafer. The silicon wafer is divided into an incremental array of tiny plate electrodes. A tiny incremental region of the liquid crystal is influenced by the electric field generated by each tiny plate and the common plate. Each such tiny plate and corresponding liquid crystal region are together referred to as a cell of the imager. Each cell corresponds to an individually controllable pixel. A common plate electrode is disposed on the other side of the liquid crystal. Each cell, or pixel, remains lighted with the same intensity until the input signal is changed, thus acting as a sample and hold. The pixel does not decay, as is the case with the phosphors in a cathode ray tube. Each set of common and variable plate electrodes forms an imager. One imager is provided for each color, in this case, one imager each for red, green and blue.

It is typical to drive the imager of an LCOS display with a frame-doubled signal to avoid 30 Hz flicker, by sending first a normal frame (positive picture) and then an inverted frame (negative picture) in response to a given input picture. The generation of positive and negative pictures ensures that each pixel will be written with a positive electric field followed by a negative electric field. The resulting drive field has a zero DC component, which is necessary to avoid the image sticking, and ultimately, permanent degradation of the imager. It has been determined that the human eye responds to the average value of the brightness of the pixels produced by these positive and negative pictures.

The drive voltages are supplied to plate electrodes on each side of the LCOS array. In the presently preferred LCOS system to which the inventive arrangements pertain, the common plate is always at a potential of about 8 volts. This voltage can be adjustable. Each of the other plates in the array of tiny plates is operated in two voltage ranges. For positive pictures, the voltage varies between 0 volts and 8 volts. For negative pictures the voltage varies between 8 volts and 16 volts.

The light supplied to the imager, and therefore supplied to each cell of the imager, is field polarized. Each liquid crystal cell rotates the polarization of the input light responsive to the root mean square (RMS) value of the electric field applied to the cell by the plate electrodes. Generally speaking, the cells are not responsive to the polarity (positive or negative) of the applied electric field. Rather, the brightness of each pixel's cell is generally only a function of the rotation of the polarization of the light incident on the cell. As a practical matter, however, it has been found that the brightness can vary somewhat between the positive and negative field polarities for the same polarization rotation of the light. Such variation of the brightness can cause an undesirable flicker in the displayed picture.

In this embodiment, in the case of either positive or negative pictures, as the field driving the cells approaches a zero electric field strength, corresponding to 8 volts, the closer each cell comes to white, corresponding to a full on condition. Other systems are possible, for example where the common voltage is set to 0 volts. It will be appreciated that the inventive arrangements taught herein are applicable to all such positive and negative field LCOS imager driving systems.

Pictures are defined as positive pictures when the variable voltage applied to the tiny plate electrodes is less than the voltage applied to the common plate electrode, because the higher the tiny plate electrode voltage, the brighter the pixels. Conversely, pictures are defined as negative pictures when the variable voltage applied to the tiny plate electrodes is greater than the voltage applied to the common plate electrode, because the higher the tiny plate electrode voltage, the darker the pixels. The designations of pictures as positive or negative should not be confused with terms used to distinguish field types in interlaced video formats.

The present state of the art in LCOS requires the adjustment of the common-mode electrode voltage, denoted VITO, to be precisely between the positive and negative field drive for the LCOS. The subscript ITO refers to the material indium tin oxide. The average balance is necessary in order to minimize flicker, as well as to prevent a phenomenon known as image sticking.

A light engine having an LCOS imager has a severe non-linearity in the display transfer function, which can be corrected by a digital lookup table, referred to as a gamma table. The gamma table corrects for the differences in gain in the transfer function. Notwithstanding this correction, the strong non-linearity of the LCOS imaging transfer function for a normally white LCOS imager means that dark areas have a very low light-versus-voltage gain. Thus, at lower brightness levels, adjacent pixels that are only moderately different in brightness need to be driven by very different voltage levels. This produces a fringing electrical field having a component orthogonal to the desired field. This orthogonal field produces a brighter than desired pixel, which in turn can produce undesired bright edges on objects. The presence of such orthogonal fields is denoted disclination. The image artifact caused by disclination and perceived by the viewer is denoted sparkle. The areas of the picture in which disclination occurs appear to have sparkles of light over the underlying image. In effect, dark pixels affected by disclination are too bright, often five times as bright as they should be. Sparkle comes in red, green and blue colors, for each color produced by the imagers. However, the green sparkle is the most evident when the problem occurs. Accordingly, the image artifact caused by disclination is also referred to as the green sparkle problem.

LCOS imaging is a new technology and green sparkle caused by disclination is a new kind of problem. Various proposed solutions by others include signal processing the entire luminance component of the picture, and in so doing, degrade the quality of the entire picture. The trade-off for reducing disclination and the resulting sparkle is a picture with virtually no horizontal sharpness at all. Picture detail and sharpness simply cannot be sacrificed in that fashion.

One skilled in the art would expect the sparkle artifact problem attributed to disclination to be addressed and ultimately solved in the imager, as that is where the disclination occurs. However, in an emerging technology such as LCOS, there simply isn't an opportunity for parties other than the manufacturer of the LCOS imagers to fix the problem in the imagers. Moreover, there is no indication that an imager-based solution would be applicable to all LCOS imagers. Accordingly, there is an urgent need to provide a solution to this problem that can be implemented without modifying the LCOS imagers.

BRIEF SUMMARY OF THE INVENTION

The inventive arrangements taught herein solve the problem of sparkle in liquid crystal imagers attributed to disclination without degrading the high definition sharpness of the resulting display. Moreover, and absent an opportunity to address the problem by modification of imagers, the inventive arrangements advantageously solve the sparkle problem by modifying the video drive signals after gamma correction, thus advantageously presenting a solution that can be applied to all liquid crystal imagers, including LCOS imagers. Slew rate limiting advantageously does not unacceptably degrade the detail of a high definition display. Moreover, the signal processing in the form of slew rate limiting can advantageously be adjusted or calibrated in accordance with the operation of the imager, and thus, can be used with and adjustably fine tuned for different imagers in different video systems.

In a presently preferred embodiment, one or more of the video drive signals, for example R, G and B, is slew rate limited after gamma correction to limit the difference in brightness levels between adjacent pixels. The slew rates are adjustable. The adjustments are advantageously independent of one another, and can advantageously be related to the operation of the imager. The sparkle reduction processing can be expected to significantly reduce the sparkle problem.

The sparkle reduction processing limits the brightness levels between adjacent pixels in such a way as to reduce the occurrence of disclination in the LCOS imager. The slew rate limits are selectable and can be expressed as a digital value, for example a digital value of 60 out of a range of 1023 digital steps (60/1023), as would be present in a 10-bit signal. The limit values chosen for the positive and negative slew rates are related to the operating characteristics of the imagers because the disclination resulting in the sparkle artifact is a function of imager operation.

DETAILED DESCRIPTION OF THE PREFERRED EMBODIMENTS

Figure 1:
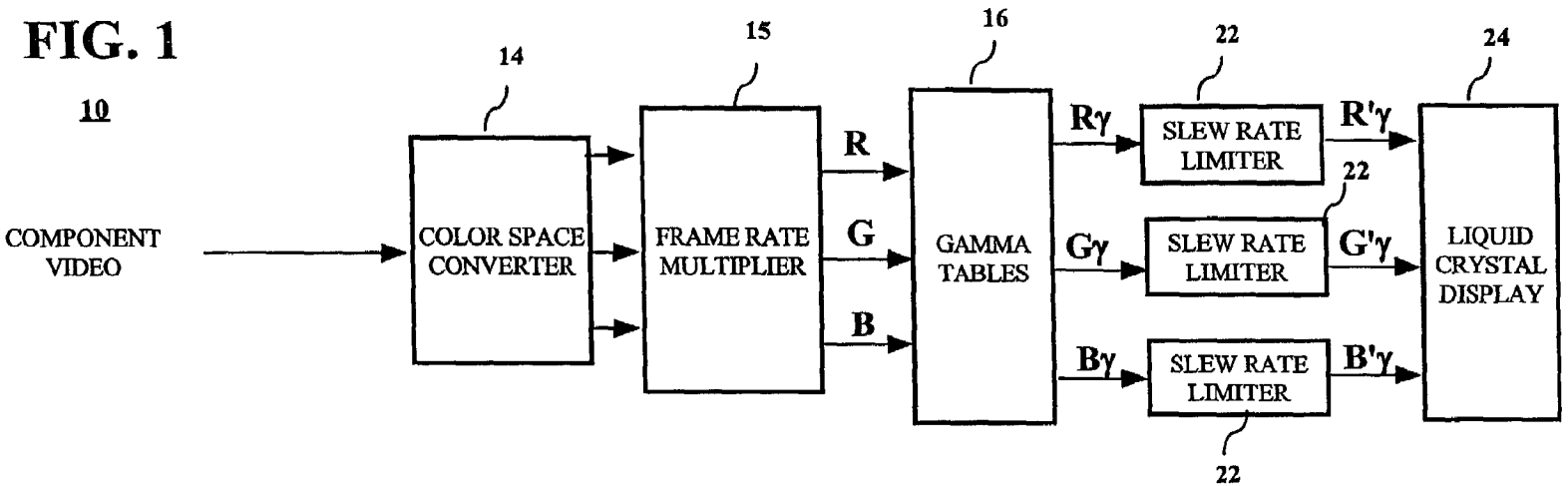
FIG. 1 is a block diagram of a video display system for a liquid crystal imager having sparkle reduction processing in accordance with the inventive arrangements.

A video display system including signal processing for reducing sparkle artifacts attributed to disclination errors in liquid crystal video systems, for example LCOS video systems, is shown in FIG. 1 and generally denoted by reference numeral 10. The video system 10 comprises a component video signal having luminance and chrominance components. The luminance and chrominance components are an input to a color space converter, or matrix, 14. The color space converter generates video drive signals, for example, R, G and B. The frame rate multipliers 15 are conventionally placed just before the gamma tables 16, and with respect to FIG. 1, immediately after the color space converter 14. The R, G and B signals from the frame rate multipliers are inputs to respective gamma tables 16. The gamma tables generate gamma corrected video drive signals Rγ, Gγ□ and Bγ. One or more of the gamma corrected video drive signals are inputs to respective slew rate limiters 22, which generate gamma corrected, slew rate limited video drive signals R'γ□, G'γ□ and B'γ. In the presently preferred embodiment, all of the gamma corrected video drive signals are slew rate limited to reduce sparkle artifacts attributed to disclination errors in the liquid crystal display 24 to which the gamma corrected, slew rate limited video drive signals are supplied. In the presently preferred embodiment, the imager is a liquid crystal on silicon imager. The gamma corrected video drive signals are digital signals, for example 10-bit or 11-bit signals. Each gamma corrected video drive signal is a digital signal, and the waveform of each gamma corrected video drive signal is a succession of digital samples representing brightness levels. The output signals R'γ, G'γ, and B'γ□ have similar digital formats.

Figure 2:
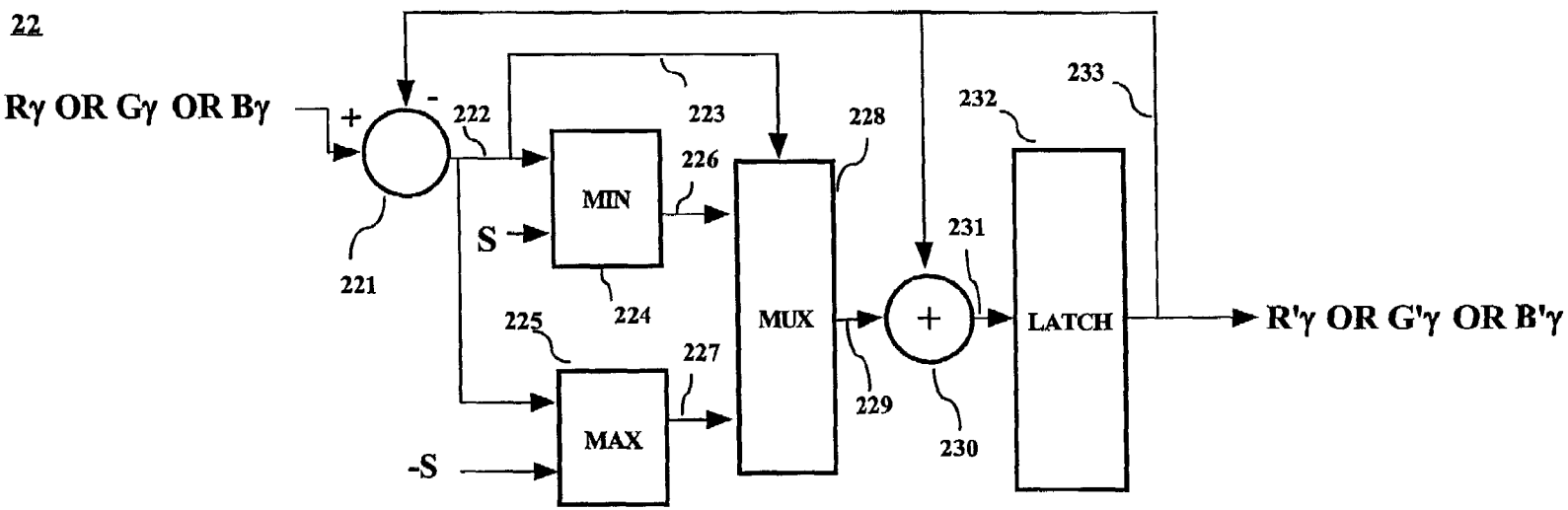
FIG. 2 is a block diagram useful for explaining the operation of the slew rate limiter in FIG. 1.

The details of each slew rate limiter 22 are shown in FIG. 2. Slew rate limiter 22 assures that successive output signals from the slew rate limiter will not vary by more than the predetermined slew rate. A gamma corrected video drive signal is an input to an algebraic unit 221. The other input to the algebraic unit 221 is the preceding output 233 of the slew rate limiter stored in latch 232. The last output value, which is a gamma corrected, slew rate limited value, is subtracted from the input value to determine the difference. The difference on output line 222 is an input to a first comparator 224 denoted MIN and a second comparator 225 denoted MAX. The difference is tested in the MIN circuit to see if the difference is greater than a positive slew limit S and is also tested in the MAX circuit to see if the difference is more negative than the negative slew limit −S. It is not necessary that the positive and negative slew limits have the same absolute value, although the same absolute value is used in the embodiment shown in FIG. 2.

The most significant bit (MSB) of the difference signal 222 is the control input 223 to a multiplexer (MUX) 228. The most significant bit of the difference indicates the polarity of the difference and selects the output 226 of comparator 224 or the output 227 of comparator 225. The output of the MIN comparator is selected when the difference is positive and the output of the MAX comparator is selected when the difference is negative. The output of the multiplexer on line 229 is a slew rate limited difference that is added to the brightness level of the previous slew rate limited output pixel in algebraic unit 230, in order to generate the next new pixel. The output of the algebraic unit 230 on line 231 is stored in the latch 232. The output of the latch 232 is a stream of gamma corrected, slew rate limited pixels. The clock signals are omitted from FIG. 2 for purposes of clarity.

The embodiment of the slew rate limiter shown in FIG. 2 incurs a one clock period delay, corresponding to a one pixel delay, even if the slew rate is not limited. Accordingly, if any of the gamma corrected video drive signals is not slew rate limited, that gamma corrected video drive signal must be delay matched, for example by the same one clock period delay. It is possible under some circumstances that the delay incurred by the slew rate limiter can exceed one clock period delay, but the delay match circuit need not be adjusted accordingly.

Although the positive and negative slew rates in the example shown in FIG. 2 have the same absolute value, this need not be the case. Advantageously, the slew rates can be set independently for sample values greater than the preceding pixel value and for sample values less than the preceding pixel value. If the positive and negative slew rates are equal to 1, for example, then successive outputs of the slew rate limiter will not differ from one another by more than 1digital value step. If a gamma corrected video drive signal has a 10-bit value, then successive outputs of the slew rate limiter will not differ from one another by more than one step out of 1,024 states, representing 1,023 steps.

The methods and apparatus illustrated herein teach how the brightness levels of adjacent pixels can be restricted or limited in the horizontal direction, and indeed, these methods and apparatus can solve the sparkle problem. Nevertheless, these methods and apparatus can also be extended to restricting or limiting brightness levels of adjacent pixels in the vertical direction, or in both the horizontal and vertical directions.

What is claimed is:

1. A method for reducing sparkle artifacts in a liquid crystal imager, comprising the steps of:

gamma correcting a video drive signal;

slew rate limiting at least a portion of said gamma corrected video drive signal deinterlacing said video drive signal to provide a deinterlaced video signal;

color space converting said deinterlaced video signal; and frame rate multiplying said color space converted video signal, said deinterlacing, color space converting and frame rate multiplying steps taking place prior to gamma correcting said video drive signal.

2. The method claimed in claim 1, wherein said step of gamma correcting further comprises the step of producing an output containing a red gamma corrected video drive signal component, a blue gamma corrected video drive signal component, and a green gamma corrected video drive signal component.

3. The method claimed in claim 2, wherein at least one of said gamma corrected video drive signal components is slew rate limited.

4. The method claimed in claim 3, comprising the further steps of independently selecting slew rate limits for each of said gamma corrected video drive signal components.

5. An apparatus for reducing sparkle artifacts in a liquid crystal imager, comprising:

a device for gamma correcting a video drive signal for providing a gamma corrected video drive signal;

a slew rate limiter coupled to said device for gamma correcting so as to receive said gamma corrected drive signal, for slew rate limiting said gamma corrected video drive signal, means for deinterlacing said video drive signal;

means for color space converting said deinterlaced video drive signal;

means for frame rate multiplying said color space converted video signal, and means for frame rate multiplying said video drive signal prior to gamma correction of said video drive signal.

6. The apparatus claimed in claim 5, further comprising: a video display system for a liquid crystal imager having a circuit for reducing sparkle artifacts in said liquid crystal imager, said circuit comprising: a color space converter for color space converting said video drive signal, wherein said gamma correcting device gamma corrects said color space converted video drive signal.

7. The apparatus claimed in claim 6, said circuit further comprising means for frame rate multiplying said color space converted video signal prior to said frame rate multiplied video signal being gamma corrected.

8. The apparatus claimed in claim 7 wherein said gamma corrected video drive signal further comprises a red gamma corrected video drive signal component, a blue gamma corrected video drive signal component, and a green gamma corrected video drive signal component.

9. The apparatus claimed in claim 8, further comprising means for independently selecting slew rate limits for each of said gamma corrected video drive signal components.

10. The apparatus of claim 5, wherein said slew rate limiter further comprises a means for assuring that successive output signals from said slew rate limiter will not vary by more than a predetermined slew rate.

11. The apparatus of claim 10, wherein said slew rate limiter further comprises:

an algebraic unit for providing a difference signal representative of a difference between said gamma corrected video drive signal and a preceding gamma corrected slew rate limited output; a latch for storing said preceding gamma corrected slew rate limited output; at least one comparator for determining whether said difference exceeds said predetermined slew rate; and a second algebraic unit for adding the output from said at least one comparator to a brightness level of a previous slew rated limited output pixel to generate a next new pixel.

12. The apparatus of claim 11, wherein said at least one comparator comprises a first comparator for determining whether said difference signal is greater than a predetermined positive slew rate and a second comparator for determining whether said difference signal is more negative than a predetermined negative slew rate.

13. The apparatus of claim 12, wherein the absolute value of said predetermined positive slew rate and the absolute value of said predetermined negative slew rate are equal.

14. The apparatus of claim 11, wherein said slew rate limiter further comprises a multiplexer that uses the most significant bit of said difference signal as a control input for selecting an output among said first comparator and said second comparator.

* * * * *